US006981600B1

(12) United States Patent
Battegazzore

(10) Patent No.: US 6,981,600 B1
(45) Date of Patent: Jan. 3, 2006

(54) TAMPER EVIDENT CLOSURE FOR BOTTLES OF QUALITY LIQUOR

(75) Inventor: Piero Battegazzore, Alessandria (IT)

(73) Assignee: Guala Closures S.p.A., Alessandria (IT)

( * ) Notice: Subject to any disclaimer, the term of this patent is extended or adjusted under 35 U.S.C. 154(b) by 75 days.

(21) Appl. No.: 10/088,373

(22) PCT Filed: Sep. 12, 2000

(86) PCT No.: PCT/IT00/00357

§ 371 (c)(1),
(2), (4) Date: Jul. 2, 2002

(87) PCT Pub. No.: WO01/23265

PCT Pub. Date: Apr. 5, 2001

(30) Foreign Application Priority Data

Sep. 27, 1999 (IT) ..... MI99A2006

(51) Int. Cl.
*B65D 41/34* (2006.01)

(52) U.S. Cl. ..... 215/252; 215/230

(58) Field of Classification Search ..... 215/252, 215/250, 230; 206/459.1, 459.5; 222/541.5, 222/541.6, 153.14
See application file for complete search history.

(56) References Cited

U.S. PATENT DOCUMENTS 3,737,064 A * 6/1973 Patel et al. ..... 215/252
3,850,328 A * 11/1974 Guala ..... 215/252
4,133,462 A * 1/1979 Lindstrom ..... 222/546
4,679,696 A * 7/1987 Bonnenfant et al. ..... 215/252
4,775,064 A * 10/1988 Baxter ..... 215/230
4,919,285 A * 4/1990 Roof et al. ..... 215/230
5,105,961 A * 4/1992 Noren et al. ..... 215/345
5,176,270 A * 1/1993 Battagazzore ..... 215/252
5,244,107 A * 9/1993 Battegazzore ..... 215/252
5,433,331 A * 7/1995 Morini ..... 215/271
5,740,932 A * 4/1998 Battegazzore ..... 215/252
6,439,411 B1 * 8/2002 Schwarz ..... 215/252
6,619,492 B2 * 9/2003 Battegazzore ..... 215/21

FOREIGN PATENT DOCUMENTS

FR 2290364 * 7/1976
FR 2490598 * 3/1982
GB 453025 * 9/1936
WO WO 91/06486 * 3/1991
WO WO 97/31838 * 9/1997

* cited by examiner

*Primary Examiner*—Robin A. Hylton
(74) *Attorney, Agent, or Firm*—Notaro & Michalos PC

(57) ABSTRACT

A closure particularly for a bottle for a good-quality liquor which renders the difference between an intact bottle and a wrongfully opened bottle unusually clear, comprises a pourer body of predetermined axis fixed axially and angularly to the bottle, a cap having a skirt screwed onto the pourer body, a sleeve in at least two portions extending around the bottle, and a tubular appendix forming around an extension of the skirt of the cap and extending around the sleeve in order to keep the at least tow portions juxtaposed.

8 Claims, 2 Drawing Sheets

TAMPER EVIDENT CLOSURE FOR BOTTLES OF QUALITY LIQUOR

The present invention relates to a closure, particularly for a bottle for a good-quality liquor, of the type comprising a pourer body of predetermined axis, fixed axially and angularly to the bottle, and a cap having a skirt which is screwed onto the pourer body.

As is known, in a closure of this type, efforts are always made to make clear to a purchaser visually that a bottle put on sale has wrongfully or fraudulently been opened by an unauthorized person.

For this purpose, a closure which is in use has a cap that is made of aluminium sheet and is screwed onto the pourer body in a manner such that, when it is unscrewed, the cap is separated from a band as a result of breakage along a line of weakening. Although this closure is advantageous from various points of view and is widely used, it leaves something to be desired from the point of view of showing that opening has taken place. The aluminium band in fact remains substantially in the vicinity of the cap once the bottle has been reclosed after opening.

SUMMARY OF THE INVENTION

The problem upon which the present invention is based is that of devising a closure of the type specified which has structural and functional characteristics such as to overcome the above-mentioned disadvantage, that is, to render clearly visible the difference between an intact bottle and a bottle which has been opened in an unauthorized manner.

This problem is solved by a closure of the type specified which is characterized in that it comprises a sleeve composed of at least two portions extending around the bottle, and a tubular appendage or appendix forming an extension of the skirt of the cap and extending around the sleeve in order to keep the at least two portions juxtaposed.

BRIEF DESCRIPTION OF THE DRAWINGS

Further characteristics and the advantages of the closure according to the present invention will become clear from the following description of a preferred embodiment thereof given by way of non-limiting example with reference to the appended drawings, in which.

Figure 1:
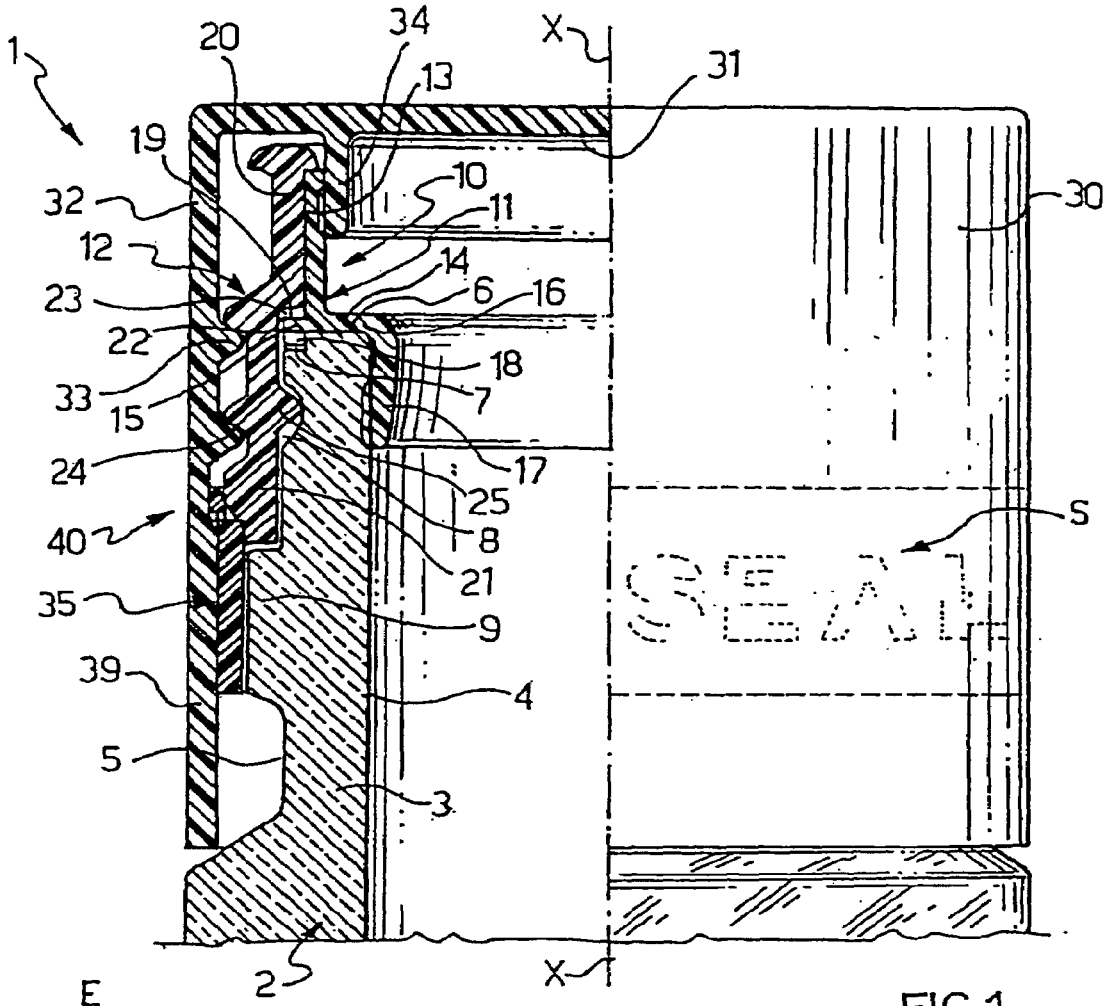
FIG. 1 is a partially-sectioned, elevational view of a closure according to the invention.
Figure 2:
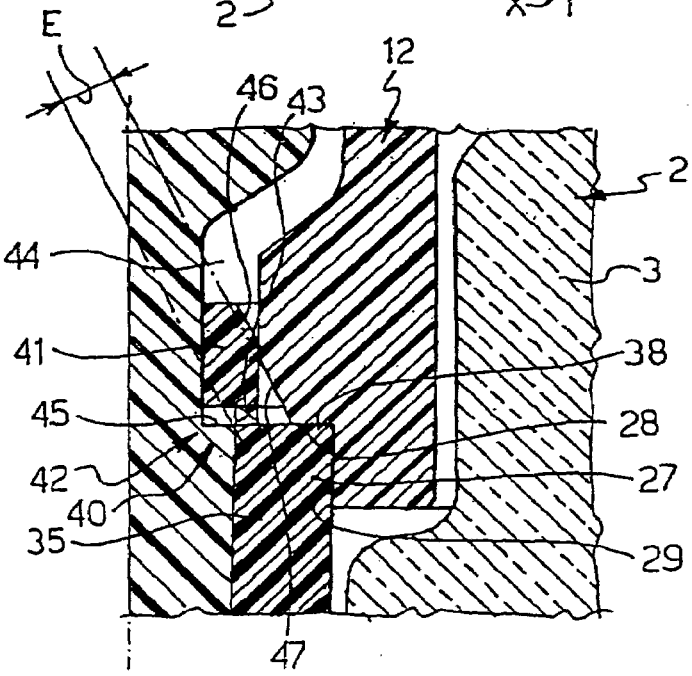
FIG. 2 shows a detail of the closure of FIG. 1, in section and on an enlarged scale.
Figure 3:
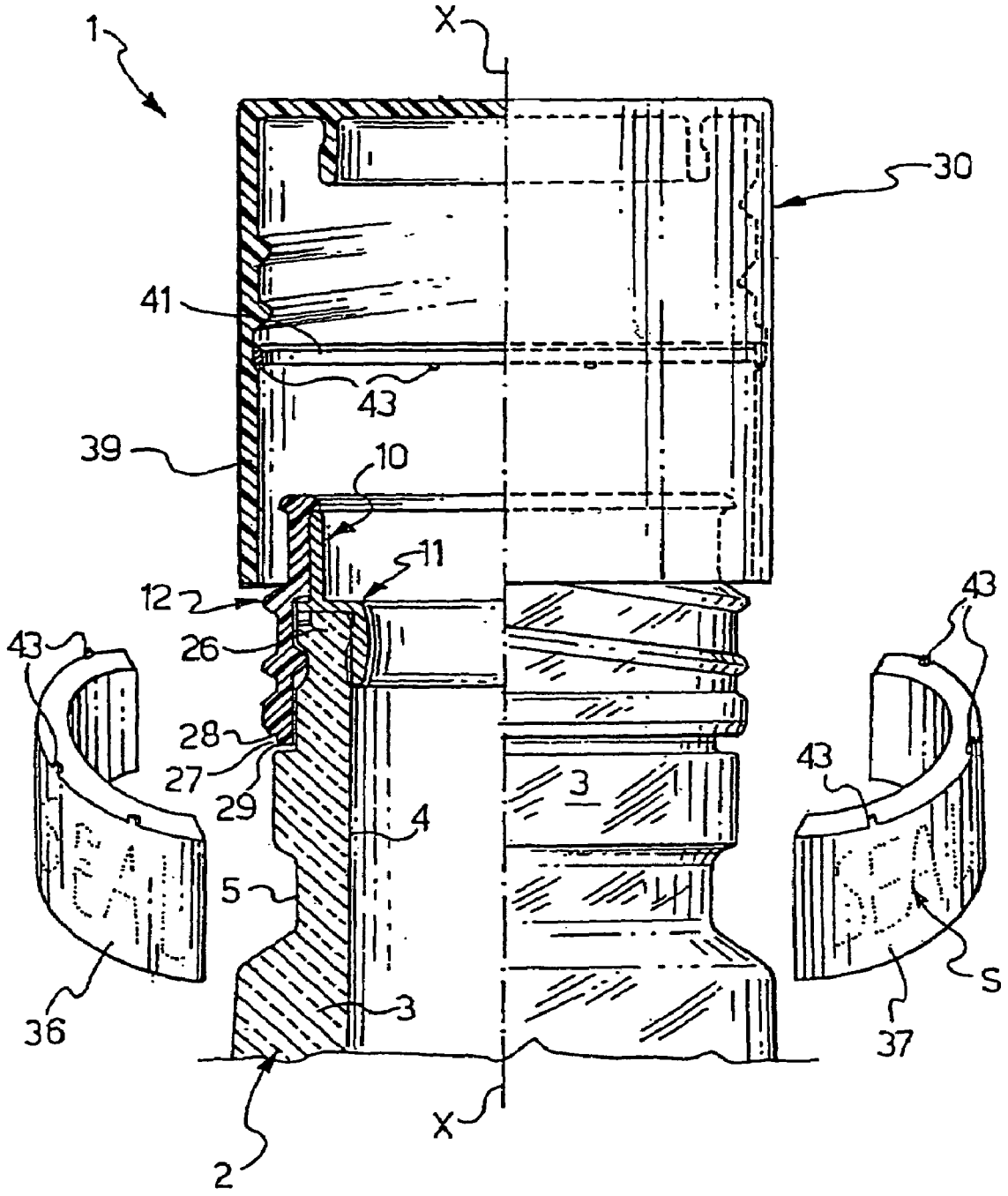
FIG. 3 shows the closure of FIG. 1 with parts separated.

With reference to the appended drawings, a closure for a bottle 2, preferably but not exclusively a bottle intended to contain a good-quality liquor, is generally indicated 1.

DESCRIPTION OF THE PREFERRED EMBODIMENT

The bottle 2 comprises a neck of axis X—X, which is defined by an inner surface 4, by an outer surface 5, and by a flat top 6.

In the flat top 6, towards the outer surface 5, the bottle has a recess 7, for example, located circumferentially at a point.

A groove 8 and a collar 9 are formed in the outer surface 5.

The closure 1 comprises a pourer body 10 of axis X—X, associated coaxially with the neck 3 of the bottle 2 and fixed axially and angularly to the bottle.

The pourer body 10 comprises an inner body 11 and an outer body 12 fixed together in the manner which will be described below.

The inner body 11, of axis X—X, comprises a tubular portion 13, a flange portion 14, projecting from the tubular portion 13 with an outer portion 15 and an inner portion 16, and a tubular portion 17.

The flange portion 14 lies on the flat top 6. A tooth 18 projects from the outer portion 15 and engages the recess 7. A tooth 19 projects from the opposite side of the outer portion 15 to the tooth 18 and is located at a point of its circular periphery.

The tubular portion 17 engages the inner surface 4 of the neck 3 with predetermined force.

The outer body 12 comprises a tubular portion 20 and a larger-diameter tubular portion 21, defining an inner shoulder 22.

A recess 23 is formed in the inner shoulder 22 and the tooth 19 is engaged therein.

A thread 24 is formed externally on the larger-diameter tubular portion 21 of the outer body 12.

An annular projection 25 formed internally in the tubular portion 21, is in engagement in the groove 8 in order to restrain the outer body 12 and the inner body 11 on the bottle 2.

The tubular portion 13 of the inner body 11 and the tubular portion 20 of the outer body 12 are juxtaposed coaxially. The tubular portion 17 of the inner body 11 and the tubular portion 21 of the outer body 12, on the other hand, are spaced apart and define an annular space 26 for housing the neck 3 of the bottle.

A step 27 is formed in the tubular portion 21, defining a shoulder 28 and a locating portion 29 having an outside diameter substantially equal to the outside diameter of the collar 9.

The closure 1 further comprises a cap 30 which comprises a top 31 and a tubular skirt 32. The tubular skirt 32 has an internal thread 33 engaged with the thread 24 by screwing. A tubular projection 34 projecting from the top 31 is in leaktight engagement with the inner body 11 of the pourer body 10.

The closure 1 according to the invention also comprises a sleeve 35 of axis X—X, which is formed in at least two portions. In the embodiment shown, the sleeve 35 is formed in two portions, that is, it is constituted by a half-sleeve 36 and a half-sleeve 37. The two half-sleeves 36 and 37 are juxtaposed to form the sleeve 35.

The sleeve 35 extends around the bottle 2 substantially at the level of the collar 9 and also extends around the outer body 12 of the pourer body 10, substantially at the level of the locating portion 29. It should be noted that an end 38 of the sleeve 35 abuts the shoulder 28.

The closure 1 according to the invention also comprises a tubular extension 39 which is integral with the skirt 32 and forms an extension of the skirt 32. The tubular extension 39 constitutes a hoop relative to the sleeve 35 and keeps its two portions, that is, the two half-sleeves 36 and 37, juxtaposed.

The cap and its tubular extension are preferably made of a transparent plastics material, for example, polystyrene or polycarbonate.

As for the sleeve 35, it is preferably made of a plastics material of a bright colour, for example red, and bears visible accentuating marks S formed in high relief, in low relief, by painting, by printing, or by perforations in the solid material.

The accentuating marks S are advantageously representative of an intact state of the closure and hence of a sealed state of the bottle.

Breakable means 40 of engagement between the sleeve 35 and the tubular extension 39 are advantageously provided in the closure 1 according to the invention. In particular, the breakable engagement means 40 comprise a ring 41 of axis X—X, coaxial with the sleeve 35 and associated therewith by means of a line of weakening 42. The line of weakening 42 takes the form of six equiangularly spaced breakable bridges 43 extending between the ring 41 and the end 38 of the sleeve.

It should be noted that, between the outer body 12 of the pourer 10 and the tubular extension 39, there is a short space E through which the ring 41 is inserted by force so as to occupy a recess 44 formed in the tubular extension 39 and delimited by a shoulder 45.

The shoulder 28 and the shoulder 45 are substantially at the same level and the space E is also at the same level, with the breakable bridges 43 extending across it.

To favour the forced insertion of the ring 41 in the recess 44 through the space E, lead-in chamfers, indicated 46 and 47, respectively are provided in the ring 41 and in the outer body 12.

When the closure 1 is unscrewed for the first time, the cap 30 moves upwards away from the pourer body 10. As soon as contact takes place between the shoulder 45 and the ring 41, there is an increase in the unscrewing effort which is perceived by the user as a security element. As the unscrewing effort continues, the line of weakening 42 breaks and the cap 30 can be removed. As soon as the cap 30 is removed, the hoop effect of the tubular extension 39 on the sleeve is lost and the two half-sleeves separate and fall to the ground.

If the cap 30 is screwed on again in an attempt re-establish the intact state of the bottle, the absence of the sleeve remains apparent and extremely obvious and the fact that unauthorized opening has taken place is sure to be noticed by the purchaser so that the attempt fails.

In other words, in operation, when the bottle is opened for the first time, the sleeve is released as a result of the unscrewing and removal of the cap so that the two half-sleeves fall to the ground and are lost. Subsequent reclosure of the cap leaves an obvious great difference between the opened bottle and intact bottles which have never been opened, precisely owing to the absence of the sleeve.

The main advantage of the closure according to the present invention lies in the unusual difference between the intact condition and the wrongfully or fraudulently opened condition of the bottle.

A further advantage of the closure according to the present invention is that it is comfortable during the opening operation. There is in fact a progression from an initial small effort to a greater effort which indicates that a security element has been overcome and, finally, a return to a small effort to complete the unscrewing.

A further advantage of the closure according to the present invention lies in the fact that the sleeve in at least two portions, which is visible from the exterior, can be formed by aesthetically pleasing elements so as to show off to further advantage the liquor bottle for which the closure is intended.

Finally, a further advantage of the closure according to the present invention is that it is structurally simple and can therefore be produced on a large or very large scale.

Naturally, in order to satisfy contingent and specific requirements, an expert in the art may apply to the above-described embodiment of the closure, many modifications and variations all of which, however, are included within the scope of protection of the invention as defined by the following claims.

What is claimed is:

1. A closure for a bottle, the bottle having a body and a neck, the neck extending along a longitudinal axis and having an inner surface, an outer surface and a flat top, the closure comprising: a pourer body fixed axially and angularly to the bottle neck, extending axially along said outer surface of the bottle neck and being provided with a bottom edge; a cap having a skirt which is screwed onto the pourer body; a sleeve having an outer surface and composed of at least two separate portions extending around the bottle neck; and a tubular appendix axially connected to said skirt of the cap, said tubular appendix extending around said sleeve and covering the outer surface of said sleeve and keeping the at least two portions circumferentially adjacent to each other before the cap is removed from the pourer body, and to allow the at least two portions of the sleeve to fall away from the bottle neck when the cap is removed from the pourer body.

2. A closure according to claim 1, wherein an annular space is provided between said tubular appendix and said pourer body, said annular space extending axially above said sleeve.

3. A closure according to claim 2, including a ring positioned inside said annular space, said ring being axially connected to the portions of said sleeve by means of a line of weakening.

4. A closure according to claim 3, wherein said ring is force fit into said annular space.

5. A closure according the claim 1, wherein said pourer body is provided, near said bottom edge, with an outwardly radially extending shoulder forming a first axial abutment and said tubular appendix of the cap skirt is provided with an inwardly radially extending shoulder forming a second axial abutment, the first and second axial abutments facing each other.

6. A closure according to claim 5, wherein the first and second axial abutments are positioned on a same plane transverse to said longitudinal axis.

7. A closure according to claim 6, wherein said tubular appendix of the cap skirt is transparent and the sleeve is brightly colored.

8. A closure according to claim 7, wherein visible marks are carried by the sleeve.

* * * * *